US007364664B2

(12) United States Patent
Shimoyama et al.

(10) Patent No.: US 7,364,664 B2
(45) Date of Patent: Apr. 29, 2008

(54) FOREIGN MATTER REMOVING MECHANISM, FLUID FLOW PROCESSING EQUIPMENT, AND FOREIGN MATTER REMOVING METHOD

(75) Inventors: Akio Shimoyama, Fukuyama (JP); Kazushi Kodama, Fukuyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 181 days.

(21) Appl. No.: 10/484,631

(22) PCT Filed: Jul. 24, 2002

(86) PCT No.: PCT/JP02/07475

§ 371 (c)(1),
(2), (4) Date: Jan. 23, 2004

(87) PCT Pub. No.: WO03/010359

PCT Pub. Date: Feb. 6, 2003

(65) Prior Publication Data

US 2004/0232091 A1 Nov. 25, 2004

(30) Foreign Application Priority Data

Jul. 25, 2001 (JP) ..... 2001-225126

(51) Int. Cl.
*B01D 21/02* (2006.01)

(52) U.S. Cl. ..... 210/801; 210/519; 210/521; 210/533; 210/538

(58) Field of Classification Search ..... 210/801, 210/519, 521, 522, 532.1, 533, 538
See application file for complete search history.

(56) References Cited

U.S. PATENT DOCUMENTS 367,308 A * 7/1887 MacNab ..... 210/521

(Continued)

FOREIGN PATENT DOCUMENTS

CA 1046668 A1 1/1979

(Continued)

OTHER PUBLICATIONS

Definition of "close" downloaded from Dictionary.com on Nov. 28, 2006; two pages.*

(Continued)

*Primary Examiner*—Christopher Upton
(74) *Attorney, Agent, or Firm*—Nixon & Vanderhye P.C.

(57) ABSTRACT

The present processing apparatus blocks off such a portion of a flow of a plating solution (17) that is other than a vicinity of a liquid surface, by using a first partition plate (15) whose lower end is in close contact with a bottom of a plating tank (11) and whose upper end is at a position lower than a liquid surface. Therefore, the plating solution (17) flowing at the bottom of the plating tank (11) flows upwards along the first partition plate (15). At this time, heavy foreign substances do not tend to follow such an upward movement of the plating solution (17), and therefore sink and accumulate in a vicinity of the lower end of the first partition plate (15), so as not to flow into a downstream side of the plate. With this arrangement, the present processing apparatus can remove the heavy foreign substances from the plating solution (17) without relying solely on a filter of a circulation pipe (10).

11 Claims, 6 Drawing Sheets

U.S. PATENT DOCUMENTS

| | | | | | |
|---|---|---|---|---|---|
| 372,216 | A | * | 10/1887 | Gaillet | 210/521 |
| 745,519 | A | * | 12/1903 | Pravicha | 210/513 |
| 801,330 | A | * | 10/1905 | Moore | 210/540 |
| 973,357 | A | * | 10/1910 | Lewis et al. | 210/519 |
| 1,190,863 | A | * | 7/1916 | Corne et al. | 210/521 |
| 1,333,287 | A | * | 3/1920 | White | 210/521 |
| 1,897,240 | A | * | 2/1933 | Dahlgren | 494/37 |
| 2,284,737 | A | * | 6/1942 | Hirshstein | 210/539 |
| 3,260,368 | A | * | 7/1966 | Wagner et al. | 210/195.1 |
| 3,300,053 | A | * | 1/1967 | Peters | 210/519 |
| 3,527,348 | A | * | 9/1970 | Lalonde et al. | 210/801 |
| 3,529,728 | A | * | 9/1970 | De Johannes et al. | 210/522 |
| 3,849,311 | A | * | 11/1974 | Jakubek | 210/188 |
| 3,933,654 | A | * | 1/1976 | Middelbeek | 210/521 |
| 4,064,054 | A | * | 12/1977 | Anderson et al. | 210/536 |
| 4,123,365 | A | * | 10/1978 | Middelbeek | 210/521 |
| 4,132,651 | A | * | 1/1979 | deJong | 210/522 |
| 4,132,652 | A | * | 1/1979 | Anderson et al. | 210/536 |
| 4,175,312 | A | * | 11/1979 | Tao et al. | 29/428 |
| 4,202,778 | A | * | 5/1980 | Middelbeek | 210/522 |
| 4,278,545 | A | * | 7/1981 | Batutis et al. | 210/521 |
| 4,422,931 | A | * | 12/1983 | Wolde-Michael | 210/168 |
| 4,634,503 | A | * | 1/1987 | Nogavich | 205/80 |
| 4,719,128 | A | * | 1/1988 | Krulik | 427/345 |
| 4,747,948 | A | * | 5/1988 | North | 210/521 |
| 4,805,553 | A | * | 2/1989 | Krulik | 118/603 |
| 4,824,579 | A | * | 4/1989 | George | 210/703 |
| 4,852,632 | A | | 8/1989 | Jackson et al. | |
| 4,943,370 | A | * | 7/1990 | Gortowski | 210/85 |
| 5,076,937 | A | * | 12/1991 | Montgomery | 210/705 |
| 5,132,010 | A | * | 7/1992 | Ossenkop | 210/522 |
| 5,286,383 | A | * | 2/1994 | Verret et al. | 210/521 |
| 5,503,747 | A | * | 4/1996 | Vion et al. | 210/519 |
| 5,531,890 | A | * | 7/1996 | Keenan | 210/242.4 |
| 5,554,301 | A | * | 9/1996 | Rippetoe et al. | 210/748 |
| 5,637,234 | A | * | 6/1997 | McCasland | 210/801 |
| 5,679,265 | A | * | 10/1997 | Van Schie | 210/776 |
| 5,795,478 | A | * | 8/1998 | Hirs | 210/521 |
| 5,874,008 | A | * | 2/1999 | Hirs | 210/708 |
| 5,989,415 | A | * | 11/1999 | Hirs | 210/138 |
| 5,993,646 | A | * | 11/1999 | Powers | 210/86 |
| 6,200,490 | B1 | * | 3/2001 | Hirs | 210/799 |
| 6,207,061 | B1 | * | 3/2001 | Pedersen et al. | 210/708 |
| 6,616,828 | B2 | * | 9/2003 | Chopra | 205/157 |
| 6,824,696 | B1 | * | 11/2004 | Tolmie et al. | 210/801 |
| 6,907,997 | B2 | * | 6/2005 | Thacker et al. | 210/521 |
| 2003/0024821 | A1 | * | 2/2003 | Chopra | 205/157 |
| 2004/0232091 | A1 | * | 11/2004 | Shimoyama et al. | 210/801 |

FOREIGN PATENT DOCUMENTS

| | | | | |
|---|---|---|---|---|
| JP | 59-232298 | | | 12/1984 |
| JP | 5-171500 | A | | 7/1993 |
| JP | 06-280099 | | | 10/1994 |
| JP | 10-311913 | | | 11/1998 |
| JP | 11-248923 | | | 9/1999 |
| JP | 2003034900 | A | * | 2/2003 |
| WO | WO 9849101 | A1 | * | 11/1998 |
| WO | WO 3010359 | A1 | * | 2/2003 |
| WO | WO 3099723 | A1 | * | 12/2003 |

OTHER PUBLICATIONS

Korean Office Action mailed Oct. 14, 2005 (w/English translation thereof).

Taiwanese Office Action and translation thereof mailed May 8, 2003 in cooresponding Taiwanese patent application No. 91116594.

Industrial Water Pollution Control, McGraw-Hill Publications Co., New York, NY, 1989, pp. 96-97.

Industrial Air Pollution Engineering, McGraw-Hill Publications Co., New York, NY, 1980, pp. 94-95.

Reynolds, "Unit Operations and Processes in Environmental Engineering", The Southeast Book Company, 1982.

"Water Pollution Prevention Technique in Electroplating", Pollution Prevention Consultants, Industrial Development Bureau & Ministry of Economic Affairs, 1993, pp. 70-71.

* cited by examiner

FOREIGN MATTER REMOVING MECHANISM, FLUID FLOW PROCESSING EQUIPMENT, AND FOREIGN MATTER REMOVING METHOD

This application is the U.S. national phase of international application PCT/JP02/07475 filed Jul. 24, 2002 which designated the U.S., and which in turn claims the benefit and priority of JP 2001-225126, the entire contents of both of which are hereby incorporated by reference.

TECHNICAL FIELD

The present invention relates to a foreign substance removing mechanism that removes foreign substances from a liquid used in a liquid flow process, which involves inflow and outflow of the liquid, relates to a liquid flow processing apparatus including the foreign substance removing mechanism, and relates to a foreign substance removing method employed by the foreign substance removing mechanism.

BACKGROUND ART

Recently, downsizing and weight saving have been carried out with respect to electronic devices such as portable information terminals In response thereto, there have been demands for downsizing, weight saving, and high density packaging with respect to semiconductor integrated circuits for use in such electronic devices.

Semiconductor integrated circuits and the like (hereinafter semiconductor devices) are manufactured through various processing steps. The processing steps include many processes, such as cleaning, etching, and plating, in which chemical solutions are used.

Taking formation of a bump electrode by plating (metal plating process) as an example, the following outlines a process in which a chemical solution is used.

Note that the bump electrode is an electrode for mounting (installing) a semiconductor device on an actual substrate of an electronic device. The mounting of the semiconductor device by using the bump electrode is widely employed as a useful method for attaining the downsizing and high density packaging of the semiconductor device.

In this mounting method, first, by using a plating technique, a bump electrode made of gold (Au) or the like is formed at a predetermined position on a front surface of a semiconductor device. Then, by using the bump electrode, the semiconductor device is directly mounted on a substrate to be mounted.

In the formation process of the bump electrode, first, a photoresist is applied to a front surface of a semiconductor substrate on which the semiconductor device has been mounted. Then, the photoresist film of a predetermined portion at which the bump is removed, so that a base metal film, which has been laminated in advance, is exposed.

After that, the semiconductor substrate is soaked in a plating solution. The bump electrode is formed by depositing plating metal (e.g. gold (Au)) on the base metal film that has been exposed after the photoresist film was removed.

Incidentally, the plating process causes that the plating metal may be deposited also on portions, other than the predetermined portion on the semiconductor substrate, i.e., on deviant portions such as a back surface of the substrate or a supporting mechanism of the substrate.

The plating metal deposited on such deviant portions is partially exfoliated from the substrate, floats or precipitates as a foreign substance in the plating solution, and moves in a plating apparatus in accordance with a flow of the plating solution. The plating solution is contaminated with plating metal particles, air bubbles, dust in the air, and the like, in some cases.

Thus, in the plating solution, there are floating and precipitated various foreign substances that have different sizes and specific gravities. These foreign substances circulate in the plating apparatus in accordance with the fluxion of the plating solution.

If these foreign substances are attached to the front surface of the substrate while the plating process is carried out, various problems are caused, such as plating error at those portions where the foreign substances are attached, or a short circuit between bump electrodes.

Therefore, in carrying out the plating process, it is necessary to pay attention to removal of the foreign substances contaminating the plating solution, as much as or more than it is necessary to pay attention to evenness of the plating.

In this regard, conventionally, a partition plate is provided in a plating tank so as to remove the foreign substances.

FIG. 6 is an explanatory diagram illustrating an arrangement of a conventional plating apparatus 101. As shown in the FIG. 6, the plating apparatus 101 includes a plating tank 111, a plating solution supply nozzle 112, a plating solution discharge nozzle 113, a circulation pump 114, a partition plate 116, a plating solution 117, a filter 119, and a gap 120 (a gap between the partition plate and a bottom surface of the plating tank).

The partition plate 116 partitions the plating tank 111 into a region A, into which the plating solution 117 flows, and a region C, in which the plating is carried out.

An upper end of the partition plate 116 is higher than a liquid surface of the plating solution (chemical solution) 117. Between a lower end of the partition plate 116 and the bottom surface of the plating tank 111, the gap 120, which is predetermined, is provided.

In the plating apparatus 101 having the arrangement above, the plating solution 117 is pressurized by the circulation pump 114. Then, the plating solution 117 passes through the filter 119, and flows via the plating solution supply nozzle 112 into the region A of the plating tank 111. After that, the plating solution 117 that have flown into the region A passes through the gap 120, and flows into the region C of the plating tank 111.

The plating solution 117 in the region C is discharged from the plating solution discharge nozzle 113. Then, the plating solution 117 is again pressurized by the circulation pump 114, so that the plating solution 117 circulates in the plating tank 111.

In the plating apparatus 101, light foreign substances (foreign substances that are smaller in specific gravity than the plating solution 17, and/or air bubbles in the plating solution 117) that have flown with the plating solution 117 into the region A rise to the liquid surface of the plating solution 117.

As described above, the upper end of the partition plate 116, which separates the region A and the region C, is higher than the liquid surface of the plating solution 117. Therefore, the foreign substances that have risen are dammed by the partition plate 116, and remain in the region A, without flowing into the region C.

Thus, the plating apparatus 101 is provided with the partition plate 116 so as to remove the light foreign substances from circulation of the plating solution 117.

However, in the plating apparatus 101 shown in FIG. 6, there is a possibility that some of the light foreign substances flow into the region C through the gap 120, which is at a lower portion of the partition plate 116, in response to the fluxion of the plating solution 117.

In contrast, foreign substances that are greater in specific gravity than the plating solution 117 (heavy foreign substances) sink to the bottom surface of the region A. Therefore the heavy foreign substances easily flow into the region C in accordance with the flow of the plating solution 117.

Most of the heavy foreign substances that have flown into the region C are discharged out of the plating tank 111 via the plating solution discharge nozzle 113, but again flow into the plating tank 111, together with the plating solution 117 circulated by the circulation pump 114. This causes that the foreign substances in the plating tank 111 (region C) increase with time.

To overcome this drawback, the plating apparatus 101 includes, as shown in FIG. 6, the filter 119 provided so as to follow the plating solution discharge nozzle 113 and the circulation pump 114, so that the foreign substances in the platting solution 117 are removed.

However, in the plating apparatus 101 shown in FIG. 6, in order to effectively remove the foreign substances in the plating solution 117, it is necessary to use (allocate as appropriate) a plurality of filters 119 in accordance with sizes and types of the foreign substances.

With time, the filter 119 becomes clogged with the foreign substances. Therefore, periodical maintenance such as replacement of the filter 119 is required. This is a heavy burden in terms of time and labor necessary for performing the maintenance, such as purchase and replacement of the filter 119.

In the foregoing explanation, problems (issues) on emergence and removal of the foreign substances are discussed, taking the plating apparatus (plating tank) as an example.

Note that the emergence of the foreign substances and necessity to remove the foreign substances are no less significant than in the plating apparatus in other liquid flow processing apparatuses (apparatuses that involve inflow and outflow of a liquid (liquid flow process); e.g. a cleaning apparatus using a chemical solution) used in steps of manufacturing semiconductor devices or other devices (e.g. liquid crystal panels).

DISCLOSURE OF INVENTION

The present invention was made to solve the foregoing conventional problems. An object of the present invention is to provide a foreign substance removing mechanism capable of removing, without relying solely on filters, foreign substances in a liquid flow processing apparatus.

To achieve the object, in a foreign substance removing mechanism (the present removing mechanism) of the present invention for removing foreign substances from a liquid used in a liquid flow process, which involves inflow and outflow of the liquid, the foreign substance removing mechanism is characterized by including a first partition plate, whose lower end is in close contact with a bottom of a flow path of the liquid, and whose upper end is at a position lower than a liquid surface.

The present removing mechanism removes foreign substances from a liquid (chemical solution, water, or the like) used for a process such as a plating process or a cleaning process that involves inflow and outflow of the liquid.

The present removing mechanism is provided, in the flow path (e.g. a pipe for liquid flow) of the liquid, on downstream or upstream side of the apparatus (liquid flow apparatus) that performs the liquid flow process, and the present removing mechanism has a function of removing the foreign substances from the liquid that flows in the flow path.

Here, the foreign substances are substances that hinder the liquid flow process. The foreign substances include litter and dust that are floating or deposited in the liquid as well as air bubbles.

Roughly speaking, the foreign substances are classified into light foreign substances and heavy foreign substances. The light foreign substances are smaller in specific gravity than the liquid. Usually, the light foreign substances are floating in a vicinity of the liquid surface. On the other hand, the heavy foreign substances are greater in specific gravity than the liquid. In many cases, the heavy foreign substances flow at the bottom of the flow path or are deposited at the bottom of the flow path.

The present removing mechanism includes the first partition plate, whose lower end is in close contact with the bottom of the flow path of the liquid, and whose upper end is lower than the liquid surface. The first partition plate blocks off the portions other than the vicinity of the liquid surface in the flow path.

In this way, in the present removing mechanism, the liquid passes above the first partition plate at a position where the first partition plate is provided.

Therefore, in the present removing mechanism, the liquid that flows in the vicinity of the bottom in the flow path moves upwards along the first partition plate. The heavy foreign substances moving in the vicinity of the bottom do not tend to follow such an upward movement of the liquid, and therefore sink and accumulate in a vicinity of the lower end of the first partition plate, so as not to flow into a downstream side of the plate.

Thus, the present removing mechanism is capable of blocking off a flow of the heavy foreign substances by the first partition plate.

This allows the present removing mechanism to remove the heavy foreign substances from the liquid without providing, in the flow path, a filter for the heavy foreign substances. As a result, it is possible to reduce the burden of maintenance of the filter, thereby reducing costs for the removal of the foreign substances (costs for the liquid flow process).

It is preferable that both sides of the first partition plate are in close contact with surfaces of respective sidewalls of the flow path.

For a fuller understanding of the nature and advantages of the invention, reference should be made to the ensuring detailed description taken in conjunction with the accompanying drawings.

BEST MODE FOR CARRYING OUT THE INVENTION

The following embodiment more specifically describes the present invention. Note that the present invention is not limited by the following embodiment.

A plating processing apparatus of the present embodiment (the present processing apparatus) is a liquid flow processing apparatus used in steps of manufacturing semiconductor devices such as semiconductor integrated circuits.

A chemical solution, use conditions, and the like of the present processing apparatus are basically the same as the chemical solution and use conditions used for manufacturing regular semiconductor devices (semiconductor integrated circuits). Therefore, explanations thereof are omitted, barring exceptions.

Figure 1:
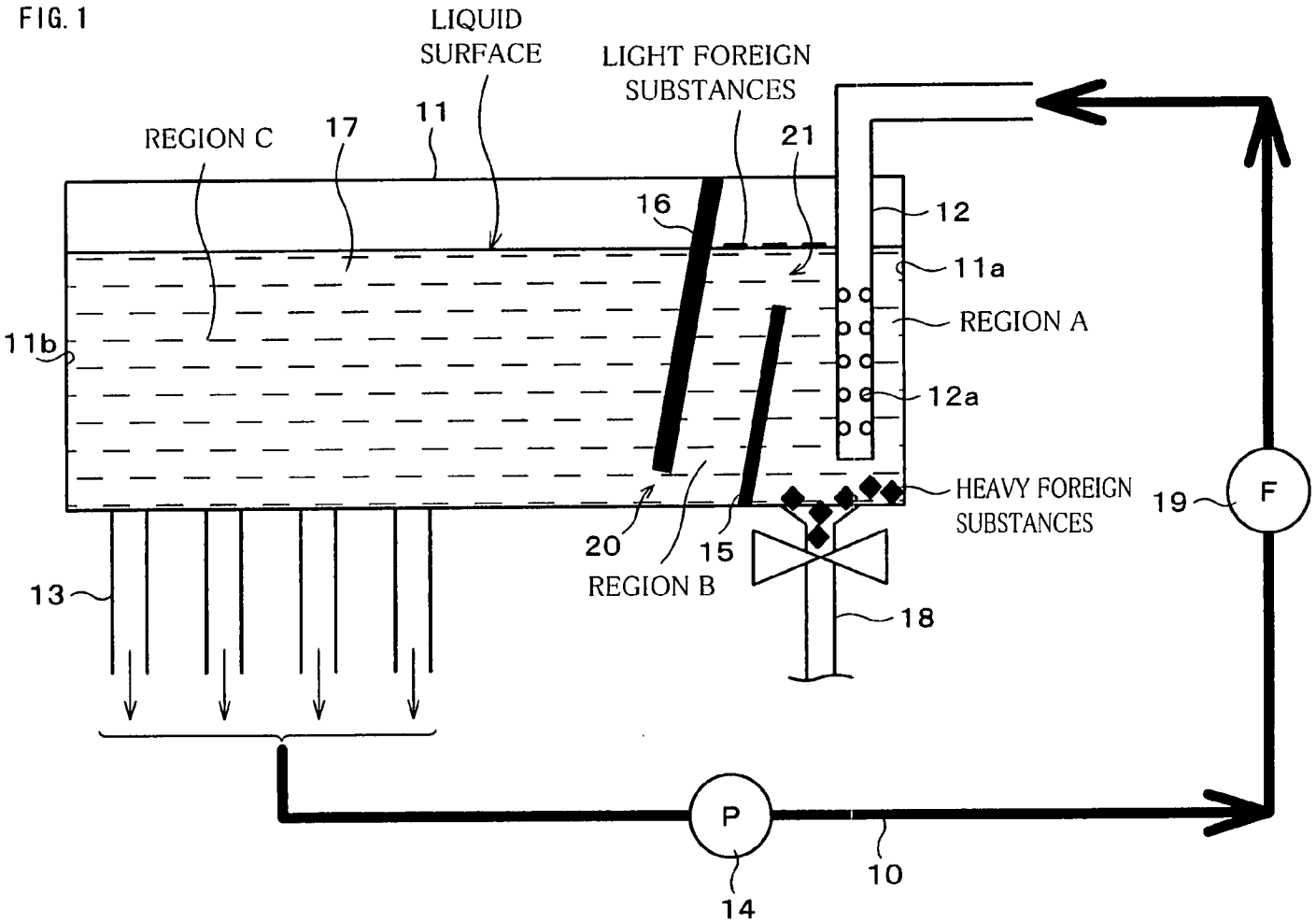
FIG. 1 is an explanatory diagram illustrating an arrangement of a plating processing apparatus (the present processing apparatus) in one embodiment of the present invention.

FIG. 1 is an explanatory diagram illustrating an arrangement of the present processing apparatus.

The present processing apparatus forms a bump electrode on a semiconductor device by metal plating processing using a plating solution 17.

As shown in FIG. 1, the present processing apparatus includes a plating tank 11, a plating solution supply nozzle (supply nozzle) 12, a plating solution discharge nozzle (discharge nozzle) 13, a circulation pump 14, a first partition plate 15, a second partition plate 16, a foreign substance discharging drain pipe 18, and a filter 19.

The plating tank (liquid flow processing tank) 11 is filled with the plating solution (e.g. gold plating solution) 17. The semiconductor device that is a target of the plating process is to be soaked in the plating tank 11.

The plating tank 11 is divided into three regions A through C by the plating plates 15 and 16. The regions A through C are connected by gap 20 and gap 21, so that the plating solution 17 can move from one region into another.

Among these regions, the region C is a region where the plating process is carried out for the semiconductor device. The regions A and B are provided for removing foreign substances in the plating solution 17, which is described later.

In the present processing apparatus, the plating solution 17 in the plating tank 11 is circulated. The discharge nozzle 13, the circulation pump 14, the filter 19, and the supply nozzle 12 are members for circulation of the plating solution 17. The supply nozzle 12 and the discharge nozzle 13 are serially connected by a circulation pipe 10 (circulation path (flow path) of the plating solution 17).

The discharge nozzle (outlet) 13 is provided at a bottom of the region C of the plating tank 11. Through the discharge nozzle 13, the plating solution 17 in the plating tank 11 is discharged toward outside by a predetermined amount at a time.

The circulation pump 14 is provided on a downstream side of the discharge nozzle 13 in the circulation pipe 10. This allows the plating solution 17 in the circulation pipe 17 to be pressurized by the circulation pump 14 so that the plating solution 17 flows from the discharge nozzle 13 toward the supply nozzle 12.

The filter 19 is provided on a downstream side of the circulation pump 14 in the circulation pipe 10, i.e., between the circulation pump 14 and the supply nozzle 12. This allows the filter 19 to remove the foreign substances (mainly heavy foreign substances and medium foreign substances (described later)) from the plating solution 17.

The supply nozzle (inflow nozzle) 12 is provided at an end of the circulation pipe 10. The supply nozzle 10 supplies the plating solution 17 to the region A of the plating tank 11.

Next, formation of the bump electrode by electrolytic plating process in the present processing apparatus is briefly described. Here, the bump electrode is provided for mounting (installing) the semiconductor device on a substrate on which an electronic device is mounted.

In the formation process of the bump electrode, first, a photoresist is applied to a front surface of a semiconductor substrate on which the semiconductor device has been mounted. Then, the photoresist film of a portion at which the bump is to be formed is removed, so that a base metal film, which is laminated in advance, is exposed. After that, the semiconductor substrate is soaked in the plating solution, so as to perform a plating process.

Figure 2:
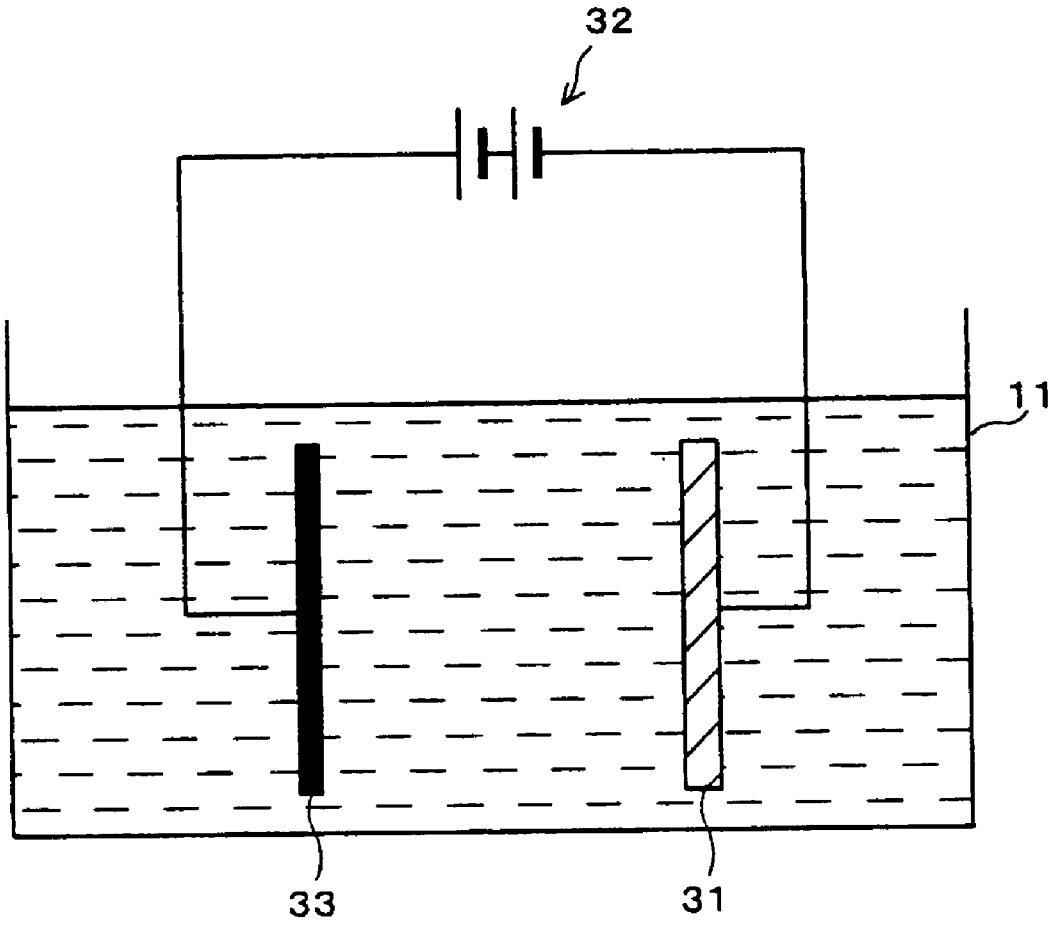
FIG. 2 is an explanatory diagram illustrating a state where a plating process for a semiconductor substrate is carried out by employing electrolytic plating, by using a plating tank of the present processing apparatus.

FIG. 2 is an explanatory diagram illustrating a state where the plating process for a semiconductor substrate 31 is carried out by employing the electrolytic plating using the plating tank 11 (region C) of the present processing apparatus.

As shown in FIG. 2, when the plating process is performed, the semiconductor substrate 31 is so disposed as to face a positive electrode 33 of a power source 32, and is connected to a negative electrode.

The bump electrode is formed by depositing plating metal (e.g. gold (Au)) on the base metal film that has been exposed after the photoresist film was removed, of the semiconductor substrate 31 (all not shown).

Next, a foreign substance removing mechanism, which is a featuring arrangement of the present processing apparatus, is described.

First, the foreign substances in the plating solution 17 are described.

The plating process causes that the plating metal may be deposited also on portions, other than the portion on the semiconductor substrate where the bump has been formed, i.e., on a deviant portion such as a back surface of the substrate). The plating metal deposited on such deviant portions is partially exfoliated from the substrate 31, floats or precipitates as a foreign substance in the plating solution 17, and moves in the present plating apparatus in accordance with a flow of the plating solution 17.

The plating solution 17 is contaminated with plating metal particles, air bubbles, dust in the air, and the like, in some cases.

In view of the circumstances, the present processing apparatus includes the following foreign substance removing mechanism so as to remove the foreign substances in the plating solution 17.

Here, an arrangement of the foreign substance removing mechanism is described.

The foreign substance removing mechanism of the present processing apparatus includes the supply nozzle 12, the first partition plate 15, the second partition plate 16, the foreign substance discharging drain pipe 18, and the filter 19, which are shown in FIG. 1.

As described above, the plating tank 11 is divided by the partition plates 15 and 16 into the three regions A through C.

As shown in FIG. 1, the plating tank 11 includes the first partition plate 15 and the second partition plate 16, in this order from the side of the supply nozzle 12.

By the partition plates 15 and 16, the plating tank 11 is partitioned into the region A, the region B, and the region C as follows. The region A (a first foreign substance trap) is defined as a region which is comparted by a side surface 11*a* of the plating tank 11 and the first partition plate 15. The region B (a second foreign substance trap) is defined as a region between the partition plates 15 and 16. The region C is defined as a region which is comparted by the second partition plate 16 and a side surface 11*b* of the plating tank 11. Here, the side surface 11*a* is a sidewall (inner wall; side surface) of the plating tank 11 which is located on an upstream side in a moving direction of the liquid.

The partition plates 15 and 16 are made of the same material as that constituting the plating tank 11.

The first partition plate 15 is provided in the plating tank 11 so that a lower end of the first partition plate 15 is in close contact with a bottom surface of the plating tank 11, and so that an upper end of the first partition plate 15 is lower than a liquid surface of the plating solution 17 in the plating tank 11. The gap 21 is provided between the upper end of the first partition plate 15 and the liquid surface of the plating solution 17, accordingly.

Also, the first partition plate 15 is provided so that both side ends thereof are in close contact with side surfaces (inner walls) of the plating tank 11, respectively.

Thus, the first partition plate 15 blocks the flow of the plating solution 17 at the bottom of the regions A and B, so as to remove the heavy foreign substances (foreign substances that are greater in specific gravity than the plating solution 17) from the plating solution 17 which is in the flowing.

In the plating tank 11, the second partition plate 16 is provided so that a lower end of the second partition plate 16 does not touch the bottom surface of the plating tank 11, and so that an upper end of the second partition plate 16 is fixed on an upper surface (ceiling surface) of the plating tank 11. The gap 20 is provided between the lower end of the second partition plate 16 and the bottom surface of the plating tank 11, accordingly. The upper end of the second partition plate 16 is higher than the liquid surface of the plating solution 17.

Note that the lower end of the second partition plate 16 is lower than the upper end of the first partition plate 15.

Moreover, as in the first partition plate 15, both side ends of the second partition plate 16 are in close contact with the side surfaces of the plating tank 11, respectively.

The second partition plate 16 blocks the flow of the plating solution 17 in a liquid surface section between the regions B and C (in a vicinity of the liquid surface of the plating solution 17), so as to remove light foreign substances (such as (i) foreign substances that are smaller in specific gravity than the plating solution 17, and/or (ii) air bubbles in the plating solution 17) from the plating solution 17 which is in the flowing.

As described above, in the supply nozzle 12, one end is connected to the circulation pipe 10 and the other end is provided in the region A of the plating tank 11.

On a side surface of the supply nozzle 12, there are provided a plurality of openings 12*a* for squirting the plating solution 17 into the region A. Moreover, a bottom (lower hole) of the supply nozzle 12 is sealed.

The openings 12*a* are disposed at positions lower than the upper end of the first partition plate 15.

The supply nozzle 12 is designed to sidewise squirt the plating solution 17 from the plurality of openings 12*a* (in other words, the openings 12*a* are sidewise opened), at such positions that are lower than the liquid surface and the upper end (position where the gap 21 is provided) of the first partition plate 15, and at such positions that are higher than the bottom surface of the region A.

The foreign substance discharging drain pipe 18 is an outlet provided on the bottom surface of the region A in the plating tank 11, i.e., the outlet is provided at the bottom surface on an upstream side of the first partition plate 15. The foreign substance discharging drain pipe 18 collects the foreign substances (heavy foreign substances) deposited on the bottom surface of the region A.

Next, foreign substance removing process that is carried out by the foreign substance removing mechanism is described.

In the present processing apparatus, the pressure of the circulation pump 14 causes that the plating solution 17, discharged from the discharge nozzle 13, sidewise spurts via the circulation pipe 10 and the supply nozzle 12, at the positions lower than the liquid surface in the region A and the upper end of the first partition plate 15.

Here, the upper end of the first partition plate 15 is lower than the liquid surface. Therefore, the plating solution 17 that has sidewise spurted into the region A is directed upwards, flows beyond (overflows) the upper end of the first partition plate 15 (gap 21) into the region B.

At this time, the heavy foreign substances, which are greater in specific gravity than the plating solution 17, do not follow the fluxion of the plating solution 17, so as to be deposited (sludged) at the bottom of the region A.

In the region B, the upper end of the second partition plate 16 is higher than the liquid surface of the plating solution 17. Therefore, the plating solution 17 that has flown into the region B cannot flow beyond the upper end of the second partition plate 16 into the region C.

On the other hand, the lower end of the second partition plate 16 is higher than the bottom surface of the plating tank 11 and lower than the upper end of the first partition plate 15. Therefore, the plating solution 17 that has flown into the region B flows downward, and flows into the region C via the gap 20.

At this time, the light foreign substances, which are smaller in specific gravity than the plating solution 17, do not follow the downward flow of the plating solution 17, so as to rise to the liquid surface of the region B and remain there.

After that, the plating solution 17 that has flown into the region C (plating processing region) is discharged from the discharge nozzle 13. The plating solution 17 thus discharged is pressurized in the circulation pipe 10 by the circulation pump 14, and is supplied again to the region A of the plating tank 11 via the filter 19.

The heavy foreign substances deposited on the bottom surface of the region A are discharged outward via the foreign substance discharging drain pipes 18, while the plating process is carried out.

There is a possibility that (a) those heavy foreign substances that have very micro sizes, and (b) those foreign substances that are similar to (not significantly different from) the plating solution 17 in specific gravity are circulated in accordance with the flow of the plating solution 17. In view of the circumstance, according to the foreign substance removing mechanism of the present processing apparatus, those foreign substances are removed by the filter 19 provided in the circulation pipe 10.

As described above, the present processing apparatus includes the foreign substance removing mechanism for removing the foreign substances from the plating solution 17. The foreign substance removing mechanism also includes the first partition plate 15, whose lower end is in close contact with the bottom of the plating tank 11, and whose upper end is lower than the liquid surface.

In the present processing apparatus, the first partition plate 15 blocks off portions other than the portions in the vicinity of the liquid surface of the flowing plating solution 17. Thus, in the present processing apparatus, the plating solution 17 passes above the first partition plate 15 at the position where the first partition plate 15 is provided.

Therefore, in the present processing apparatus, the plating solution 17 flowing in the vicinity of the bottom of the plating tank 11 moves up along the first partition plate 15.

At this time, the heavy foreign substances moving in the vicinity of the bottom do not tend to follow such an upward movement, and therefore sink and accumulate in the vicinity of the lower end of the first partition plate 15 without flowing into a downstream side of the first partition plate 15.

Thus, the present processing apparatus blocks off the flow of the heavy foreign substances by the first partition plate 15.

This enables the present processing apparatus to remove the heavy foreign substances from the plating solution 17, without relying solely on the filter 19 provided in the circulation pipe 10. Therefore, it is possible to reduce the number of the filter 19, and to reduce the burden of maintenance of the filter 19. As a result, it is possible to reduce costs for the removal of the foreign substances and for the plating process.

The present processing apparatus also includes the second partition plate 16, whose upper end is higher than the liquid surface, whose lower end is lower than the liquid surface, and which is provided so as not to be in close contact with the bottom of the plating tank 11.

Thus, the second partition plate 16 of the present processing apparatus blocks off portions other than the portions in the vicinity of the bottom of the plating tank. In this way, in the present processing apparatus, the plating solution 17 passes below the lower end of the second partition plate 16 at a position where the second partition plate 16 is provided.

Therefore, in this arrangement, the plating solution 17 flowing in the vicinity of the liquid surface of the plating tank 11 flows downward along the second partition plate 16.

At this time, the light foreign substances floating in the vicinity of the liquid surface do not tend to follow such a downward fluxion, and therefore float and accumulate in the vicinity of the lower end of the second partition plate 16 without flowing into a downstream side of the second partition plate 16.

Thus, the present processing apparatus can block off the flow of the light foreign substances by the second partition plate 16. This makes it possible to further reduce a burden of removing the foreign substances on the filter 19. Therefore, the maintenance of the filter 19 can be carried out more easily. As a result, it is possible to drastically reduce costs for the removal of the foreign substances and costs for the plating process.

The partition plates 15 and 16 are made of the same material as that constituting the plating tank 11, and have simple arrangements (mechanisms), respectively. Therefore, costs for newly providing the partition plates 15 and 16 are very low.

In the present processing apparatus, the lower end of the second partition plate 16 is at a position lower than the upper end of the first partition plate 15.

This ensures that the flow path of the plating solution 17 is blocked off at every height by the partition plate 15 and/or the partition plate 16. Therefore, it is possible to prevent those foreign substances that are flowing in a vicinity of a middle of the liquid flow from slipping via the partition plates 15 and 16. Moreover, it is possible to prevent the light foreign substances from flowing beyond the lower end of the second partition plate 16 into the region C.

In the present processing apparatus, a foreign substance removing tank (the regions A and B) is integrally provided with a liquid flow processing tank (region C), in which the process involving inflow and outflow of the plating solution 17 is carried out, that is, the regions A and B partially constitute the plating tank 11). Specifically, the plating tank 11 includes the first and second partition plates 15 and 16, the supply nozzle 12, and the discharge nozzle 13, so that the plating solution 17 that has flown beyond the second partition plate 16 directly flows via the gap 20 into the region C.

This makes it possible to simplify the arrangement of the present processing apparatus.

Moreover, the present processing apparatus has the foreign substance discharging drain pipe 18 at the bottom portion of the plating tank 11 on an upstream side of the first partition plate 15.

The present processing apparatus is so designed that the heavy foreign substances are accumulated on the bottom portion (that is, the bottom portion of the region A) of the plating tank 11 on the upstream side of the first partition plate 15. Therefore, by thus providing the foreign substance discharging drain pipe 18 at this portion, it is possible to easily collect the heavy foreign substances.

Moreover, the present processing apparatus has, in the circulation pipe 10, the filters 19 for removing the foreign substances. By thus using the filter 19 as well as the first and second partition plates 16, the foreign substances can be removed more effectively.

As described above, the present processing apparatus can remove most of the foreign substances by the first and second partition plates 16. Therefore, even if the filters 19 are thus used, the number of the filters 19 may be reduced. Moreover, it is possible to prolong the time interval (life of the filter 19) between replacements of the filter 19. As a result, costs and labor for the maintenance of the filters 19 can be reduced.

Moreover, the present processing apparatus is designed so that the supply nozzle 12 is provided in the region A, on the bottom surface of which the heavy foreign substances are accumulated.

Moreover, the openings 12*a* of the supply nozzle 12 are sidewise formed, and are disposed at positions lower than the upper end of the first partition plate 15.

If the openings 12*a* of the supply nozzle 12 (holes through which the plating solution 17 is squirted) are disposed at positions higher than the liquid surface, the plating solution 17 that has been squirted drops onto the liquid surface. Of concern here is a possibility that the dropping generates air bubbles, and the air bubbles, by floating up, cause the heavy foreign substances to soar, and eventually lead the heavy foreign substances into the area B.

In cases where, for example, (a) the supply nozzle 12 is provided so as to run through the bottom surface of the region A from below, and (b) the openings are provided on the bottom surface, there is still a possibility that the deposited heavy foreign substances soar and flow into the region B.

In contrast, in the present processing apparatus, the openings 12*a* of the supply nozzle 12 are provided at such positions that are lower than the liquid surface of the plating solution 17 and that are higher than the bottom surface of the region A. This prevents the dropping of the plating solution 17 and soaring of the heavy foreign substances, thereby preventing the heavy foreign substances from flowing into the region B.

Moreover, in the present processing apparatus, the openings 12*a* of the supply nozzle 12 are disposed at such levels that are lower than the upper end of the first partition plate 15. This ensures that the plating solution 17 supplied to the region A is directed upwards and flows toward the region B. Therefore, it is easy to cause the heavy foreign substances that has flown into the region A to sink to the bottom surface of the region A.

Moreover, in the present processing apparatus, the supply nozzle 12 is designed so that its lower end is sealed, and so that the plating solution 17 is sidewise squirted (i.e., in parallel with the bottom surface of the plating tank 11) from the openings 12*a* provided in the side surface of the supply nozzle 12, namely, the openings 12*a* are sidewise provided).

Unlike the arrangement where the plating solution 17 is squirted downward, the present arrangement more effectively prevent the heavy foreign substances deposited at the bottom of the region A from soaring and following the fluxion of the plating solution 17.

In the present processing apparatus, there are provided a plurality of openings 12*a*. This makes it possible to reduce a speed at which and a pressure under which the plating solution 17 is squirted, thereby more effectively preventing the occurrence of air bubbles and the soaring of the heavy foreign substances.

It is preferable that the supply nozzle 12 is as long as possible, provided that the foreign substances at the bottom of the region A do not soar. This is to prevent that the openings 12*a* of the supply nozzle 12 are above the liquid surface of the plating solution 17 even if the liquid surface fluctuates.

The following describes an experimental result that specifically shows effects of the foreign substance removing mechanism of the present processing apparatus.

First, outer sizes of members of the present processing apparatus used in this experiment are explained. The plating tank 11 of the present apparatus was 400 mm in width, 300 mm in depth, and 300 mm in height.

The first partition plate 15 was attached to the side surfaces and the bottom surface of the plating tank 11 so that the lower end of the first partition plate 15 was 100 mm away from the side surface 11*a*, and so that an angle θ1 (see FIG. 3; an angle formed by the liquid surface of the plating solution 17 and a plane including the first partition plate 15) was 75°. A height of the upper end of the first partition plate 15 was 130 mm.

The second partition plate 16 was disposed so as to be parallel to the first partition plate 15, and so as to be 30 mm away from the first partition plate 15. A width of the gap 20 between the lower end of the second partition plate 16 and the bottom surface of the plating tank 11 was 20 mm. The second partition plate 16 was attached to the side surfaces of the plating tank 11 so that the upper end of the second partition plate 16 was in contact with the upper surface of the plating tank 11 (that is, the upper end of the second partition plate 16 was at a height of 300 mm). A gap between a lower end of the supply nozzle 12 and the bottom surface of the plating tank 11 was 20 mm.

In this arrangement, a difference in height between the upper end of the first partition plate 15 and the lower end of the second partition plate 16 was 110 mm. A supply amount of the plating solution 17 from the supply nozzle 12 and a discharge amount of the plating solution 17 from the discharge nozzle 13 were controlled so that the liquid surface of the plating solution 17 was always 160 mm away from the bottom surface.

Therefore, a distance (a width of the gap 21) between the upper end of the first partition plate 15 and the liquid surface of the plating solution 17 was 30 mm, and a distance between the lower end of the second partition plate 16 and the plating liquid surface was 140 mm.

The liquid surface was controlled as follows. Flow meters (e.g. ultrasonic flow meters) capable of electrically feedbacking measured values were respectively attached to the pipes (supply nozzle 12, discharge nozzle 13, and circulation pipe 10). A liquid surface sensor was attached to the plating tank 11. The liquid surface was controlled by calculating and adjusting power of the circulation pump 14 so that the supply amount of the supply nozzle 12 and the discharge amount of the discharge nozzle 13 are fixed by a control section (not shown), when the liquid surface reaches 160 mm.

A non-cyanic electrolytic plating solution was used as the plating solution 17. The plating solution 17 was circulated by employing conventional temperature adjustment and liquid amount adjustment, so as to form a gold bump (gold bump electrode) of approximately 18 μm in height on a silicon wafer of not more than 8 inches by employing electrolytic plating.

It was confirmed that those foreign substances in the plating solution 17 whose particle diameters were 2 μm or larger could be reduced to approximately 150 pieces/10 ml at maximum by using the present processing apparatus having the foregoing sizes and conditions.

Here, the present processing apparatus was designed so that the filter 19 removed only (a) the medium foreign substances (foreign mattes whose specific gravity is equivalent to that of the plating solution 17) and (b) a part of the heavy foreign substances.

Figure 6:
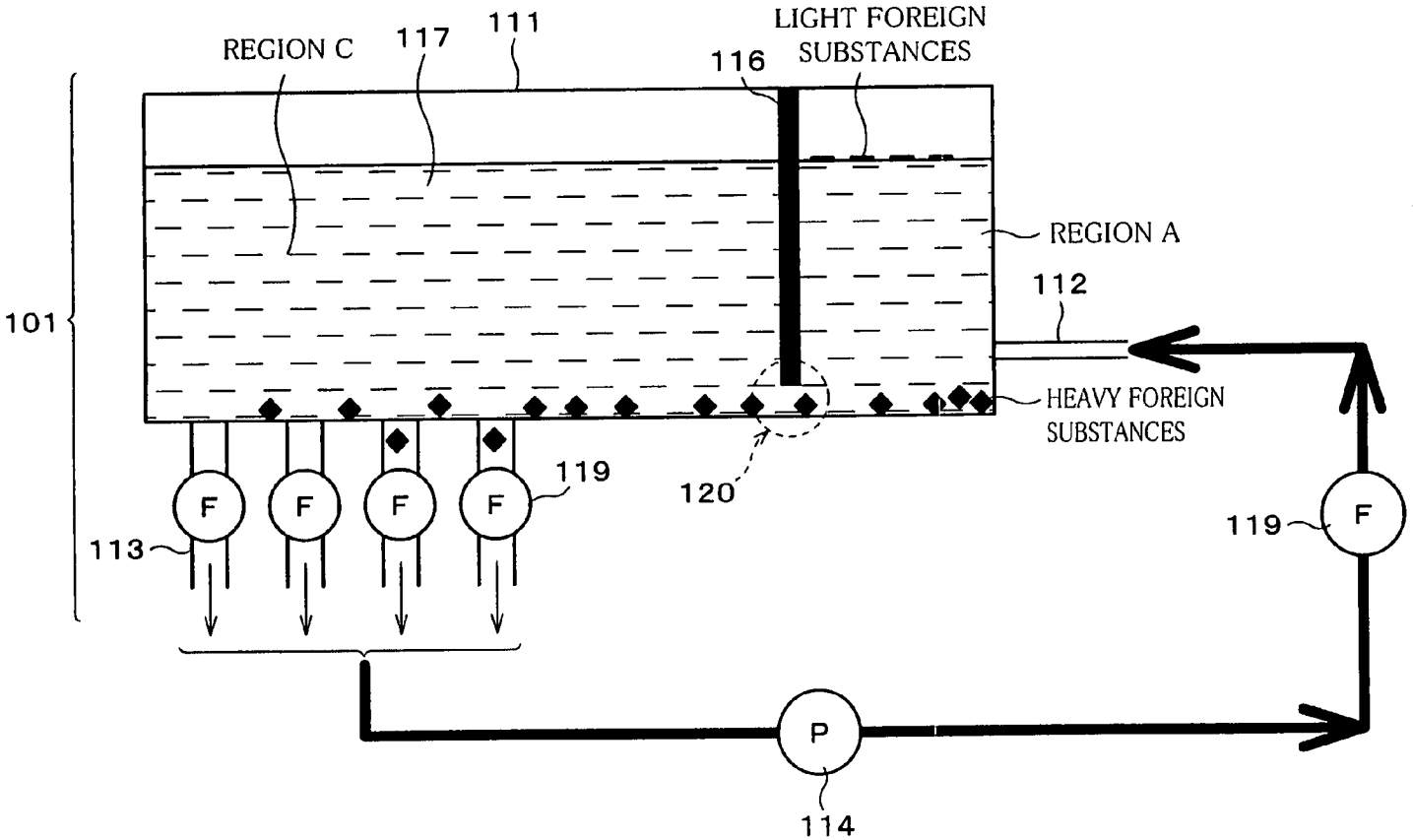
FIG. 6 is an explanatory diagram illustrating an arrangement of a conventional plating processing apparatus.

In contrast, a conventional apparatus was so designed that filters 19 remove all the heavy foreign substances and medium foreign maters in the plating solution 17. Moreover, as shown in FIG. 6, the number of filters in the conventional apparatus was five times greater than that of the present processing apparatus. As a result of measurement using the conventional apparatus, it was confirmed that in the plating solution 17 there were approximately 200 pieces/10 ml at maximum of the foreign substances that have the foregoing particle diameters.

Thus, it was confirmed that the present processing apparatus was capable of effectively removing the heavy foreign substances (removing in region A most of the heavy foreign substances). That is, it was confirmed that the number of the filters 19 could be reduced to at least one-fifth as compared with the conventional apparatus (reduction by 80%).

As a result, it was found that the present processing apparatus was capable of attaining reduction (approximately 160 thousand yen/month) of costs for purchasing the filters 19 and reduction (approximately 10 hours/month) of time for replacing the filters 19.

The first partition plate 15 of the present processing apparatus may be directed in a direction perpendicular to the liquid surface of the plating solution 17 (or the bottom surface of the plating tank 11), that is, in a normal line direction of the liquid surface. However, if the upper end of the first partition plate 15 is inclined toward an upstream-side of the circulation pipe 10 (on an upstream side in a flow direction), so that an angle between the first partition plate 15 and the liquid surface is scooched from 90°, it is possible to more effectively remove the foreign substances.

In this case, it is preferable that the first partition plate 15 is scooched in such a direction that a gap between the first partition plate 15 and the sidewall 11*a* is narrower at an upper portion thereof whereas becomes wider toward a lower portion thereof (toward the bottom surface of the plating tank 11).

Figure 3:
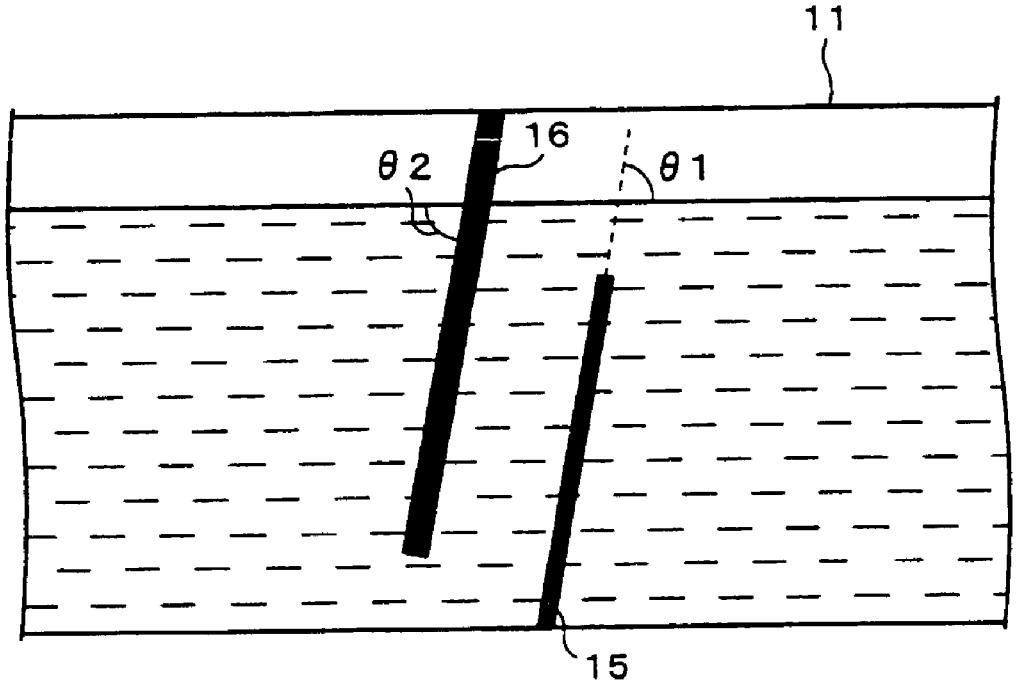
FIG. 3 is an explanatory diagram showing angles of partition plates of the present processing apparatus.

That is, as shown in FIG. 3, when an angle θ1 between the first partition plate 15 and the liquid surface is smaller than 90°, it is possible to smoothen the flow of the plating solution 17 in the regions A through C.

If the angle θ1 is 90°, the plating solution 17 that has overflown the first partition plate 15 falls perpendicularly onto the bottom surface of the region B.

On the other hand, if the angle θ1 is 90° or less, it is possible to smoothen the flow of the plating solution 17 flowing toward the bottom surface of the region B. Therefore, it is possible to buffer a shock caused when the plating solution 17 hits the bottom surface of the region B, thereby suppressing the occurrence of air bubbles.

Moreover, it is preferable that the second partition plate 16 is provided to be substantially parallel to the first partition plate 15. This makes it possible to keep constant a liquid flow area (area which varies depending on a distance between the partition plates 15 and 16) of the plating solution 17 in the region B.

This prevents variations of flow speed and flow pressure of the plating solution 17 (occurrence of a turbulent flow). As a result, it is possible to prevent the light foreign substances (that are about to float) from being involved into the flow of the plating solution 17, and to prevent the occurrence of air bubbles, and the like.

It is also preferable that the widths of the gap 20 and the gap 21 are the same as the width of the gap between the partition plates 15 and 16. This makes it possible to further smoothen the flow of the plating solution 17.

In order to further smoothen the flow of the plating solution 17, it is preferable that the angles θ1 and θ2 of the partition plates 15 and 16 (see FIG. 3) are close to zero, respectively. However, if the angles θ1 and θ2 are narrowed too much in order to increase such a volume for removing the foreign substances in the plating tank 11 foreign substance (a volume that may be seized by the partition plates 15, and 16), a plating processing space in the region C is narrowed, accordingly.

If the angles θ1 and θ2 are narrowed with securing the plating processing space in the region C, the plating tank 11 becomes large. This increases an area for installing the present processing apparatus therein, and an amount of the plating solution 17 used in the plating tank 11.

Therefore, considering the foregoing points, it is preferable that the angles θ1 and θ2 of the partition plates 15 and 16 are set to approximately 75°, respectively.

As to installation positions of the partition plates 15 and 16 (volumes of the regions A and B), there is no particular limitation. Therefore, appropriate positions may be chosen in light of properties and a flow amount of the plating solution 17, a volume of the region C, and the like.

In the present embodiment, the upper end of the second partition plate 16 is so fixed as to be in contact with the upper surface of the plating tank 11. However, the upper end of the second partition plate 16 may have any height, as long as the upper end is above the liquid surface of the plating solution 17.

Likewise, the width of the gap 21 (distance between the upper end of the first partition plate 15 and the liquid surface), the distance between the upper end of the second partition plate 16 and the liquid surface, the width of the gap 20 (gap between the lower end of the second partition plate 16 and the bottom surface of the plating tank 11), the difference in height between the upper end of the first partition plate 15 and the lower end of the second partition plate 16, and the like, are not particularly limited, and therefore may be arranged appropriately in light of the properties and flow amount of the plating solution 17, for example.

In the present embodiment, the lower end of the second partition plate 16 is lower level than the upper end of the first partition plate 15. However, the present invention is not limited to this arrangement. The lower end of the second partition plate 16 may be higher than the upper end of the first partition plate 15 and lower than the liquid surface. Even with this arrangement, the heavy foreign substances and those light foreign substances that are particularly floaty can be removed by the partition plates 15 and 16, without fail.

In the present embodiment, the foreign substance removing mechanism includes the two partition plates 15 and 16. However, the present invention is not limited to this arrangement. The foreign substances may be removed by the first partition plate 15 only.

Even with this arrangement, it is possible to excellently remove the foreign substances from the plating solution 17. This prevents the filter 19 from being clogged, thereby reducing the number of the filters 19 necessary for the foreign substance removing mechanism, and prolonging the time interval between replacements of the filter 19.

In the plating tank 11, the second partition plate 16 may be provided on an upstream side of the first partition plate 15 (on a side of the side surface 11*a*).

Moreover, three or more partition plates may be provided in the plating tanks 11.

Figure 4:
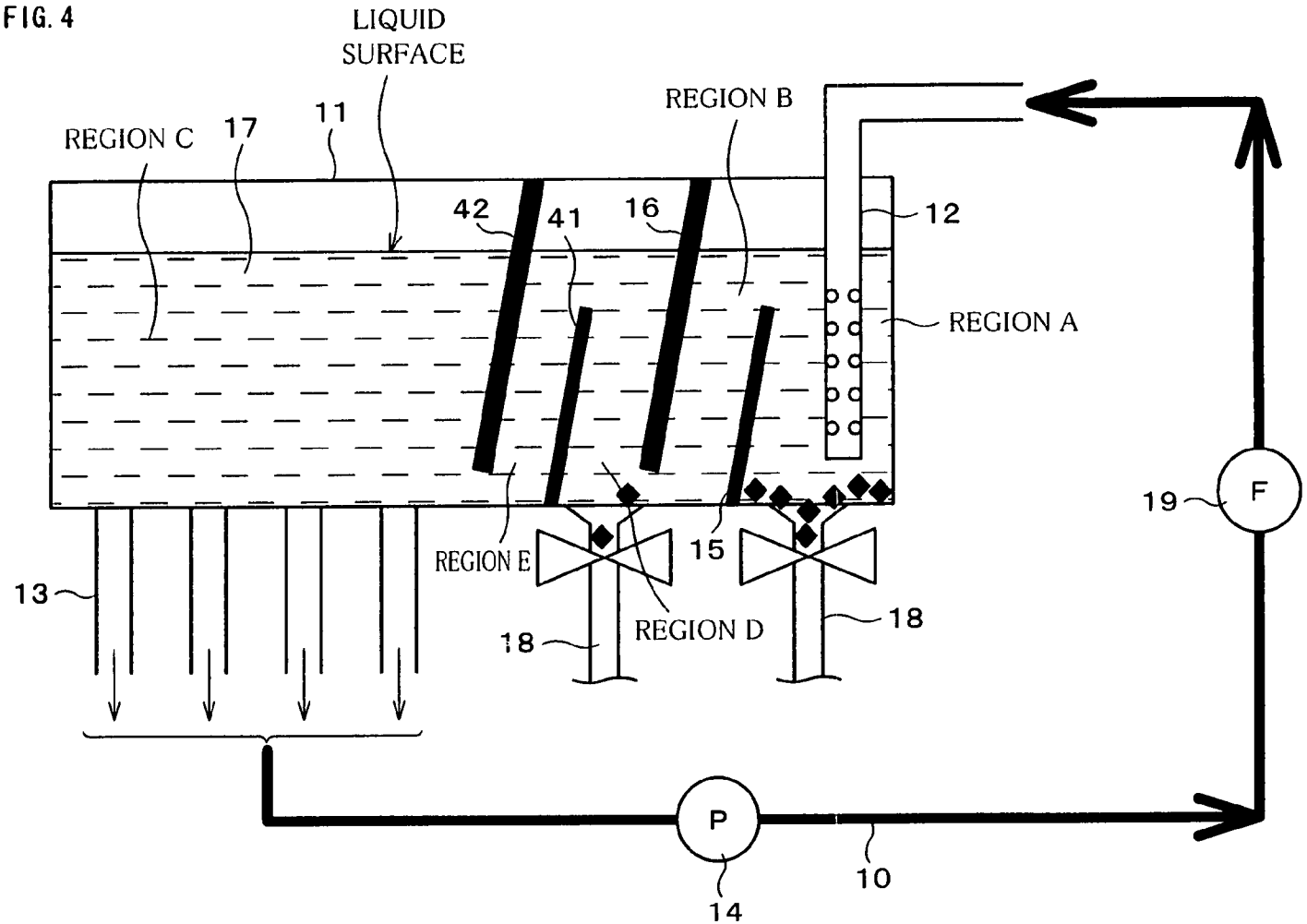
FIG. 4 is an explanatory diagram illustrating an arrangement of the present processing apparatus in which a second partition plate is followed by a third partition plate and a fourth partition plate.

For example, as shown in FIG. 4, there may be a third partition plate 41 and a fourth partition plate 42 following the second partition plate 16.

In this arrangement, like the first partition plate 15, the third partition plate 41 is provided so that a lower end thereof is in close contact with the bottom surface of the plating tank 11, and an upper end thereof is lower than the liquid surface of the plating solution 17 in the plating tank 11.

Moreover, the third partition plate 41 is provided so that both side ends thereof are in close contact with the side surfaces of the plating tank 11, respectively.

Like the second partition plate 16, the fourth partition plate 42 is provided so that a lower end thereof does not contact the bottom surface of the plating tank 11, and an upper end thereof is in contact with the upper surface (ceiling surface) of the plating tank 11 (alternatively, the upper end of the first partition plate 42 may be fixed to the upper surface of the plating layer 11).

The upper end of the fourth partition plate 42 is higher than the liquid surface of the plating solution 17. The lower end of the fourth partition plate 42 is lower than the upper end of the third partition plate 41.

Moreover, both side ends of the fourth partition plate 42 are provided so as to be in close contact with the side surfaces of the plating tank 11.

With this arrangement, as shown in FIG. 4, the heavy foreign substances that have passed through the regions A and B are removed in a region D (region between the second partition plate 16 and the third partition plate 41). The light foreign substances that have passed through the areas A, B, and D are held up within region E.

By thus providing plural sets of two types of foreign substance removing regions (regions for removing the foreign substances), it is possible to more effectively remove the foreign substances in the foreign substance removing mechanism.

The number of partition plates is not limited to two or four; the number may be three, or more than four (more than four stages).

As shown in FIG. 4, in case the number of partition plates is increased, it is preferable that the foreign substance discharging drain pipe 18 is provided on the bottom surface of each region (regions A and D) on which the heavy foreign substances precipitate.

Figure 5:
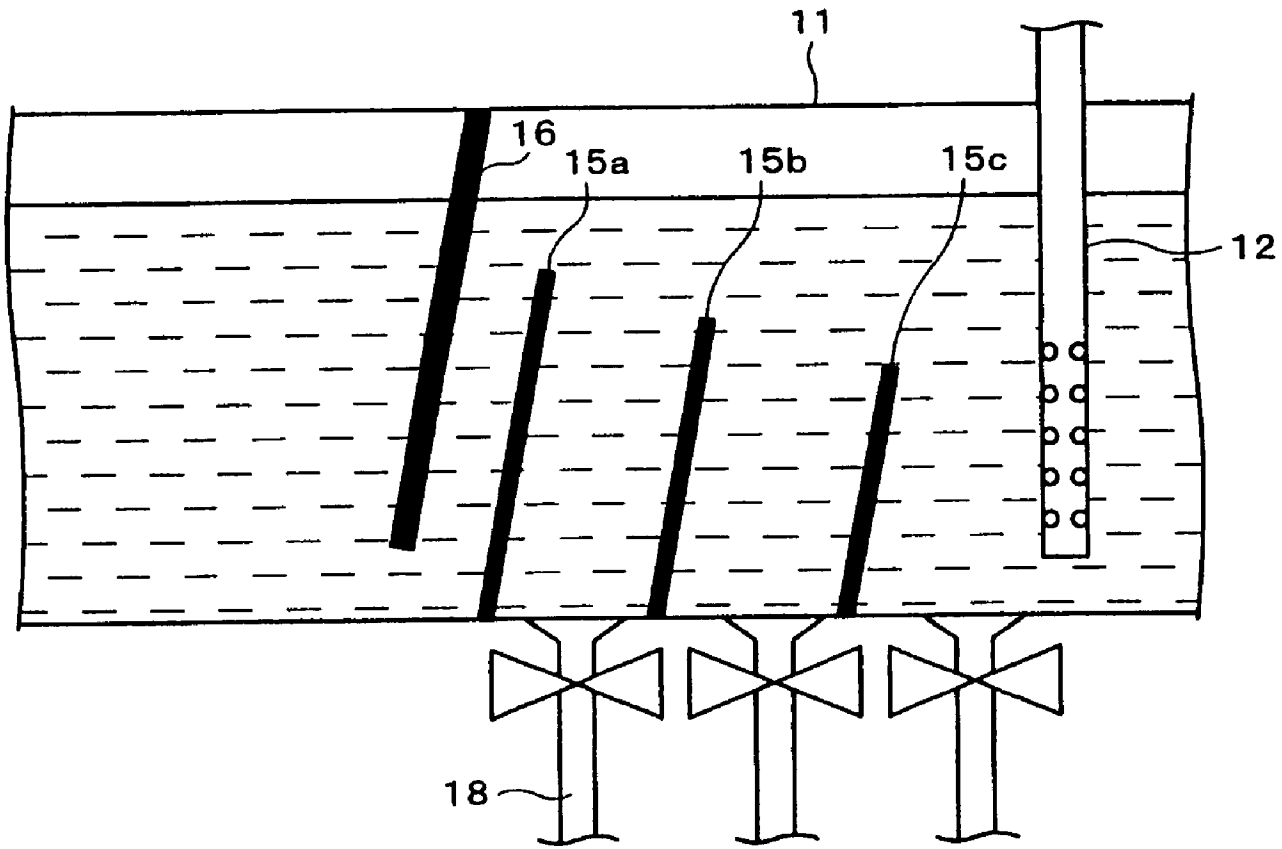
FIG. 5 is an explanatory diagram illustrating an arrangement of the present processing apparatus in which there are provided a plurality of partition plates similar to the first partition plate.

Moreover, as shown in FIG. 5, there may be provided side by side a plurality of (three, in FIG. 5) partition plates 15*a* through 15*c* whose lower ends are in close contact with the bottom surface of the plating tank 11, whose upper ends are lower than the liquid surface of the plating solution 17 in the plating tank 11, and whose both end surfaces are in close contact with the side surfaces of the plating tank 11, respectively.

With this arrangement, the flow of the plating solution 17 at the bottom portion is blocked off by the three partition plates 15*a* through 15*c*. This makes it possible to effectively remove the foreign substances that reach the second partition plate 16.

It is also preferable in the arrangement of FIG. 5 that the foreign substance ejecting drain pipe 18 is provided to each region between the side surface 11*a* of the plating tank 11 and the respective partition plates 15*a* through 15*c*.

In the present embodiment, the plating tank 11 of the present processing apparatus has the partition plates 15 and 16, and the foreign substance discharging drain pipe 18, so as to remove the foreign substances inside the plating tank 11. However, the present invention is not limited to this arrangement. It may be arranged so that, in addition to the plating tank 11, another tank for containing the plating solution 17 (foreign substance removing tank) is separately provided in the course of the circulation pipe 10 of the present processing apparatus, and so that the partition plates 15 and 16, and the foreign substance ejecting drain pipe 18 are provided inside this tank.

With this arrangement, it is not necessary to provide, inside the plating tank 11, the partition plates 15 and 16, and the foreign substance discharging drain pipe 18. Therefore, it is possible to miniaturize the plating tank 11.

In this arrangement, it is preferable that the foreign substance removing tank includes an outlet for discharging the plating solution 17 therethrough. If a sidewall (side surface) on the downstream side of the foreign substance removing tank is used as the second partition plate 16, the gap 20 functions as the outlet.

Moreover, it is not particularly necessary that the present processing apparatus includes the foreign substance removing tank. In an arrangement where the foreign substance removing tank is not provided, the partition plates 15 and 16, and the foreign substance ejecting drain pipe 18 are to be provided inside the circulation pipe 10.

In this arrangement, the regions for removing the foreign substances can be reduced. Therefore, it is possible to miniaturize the present processing apparatus.

In case the partition plates 15 and 16, and the foreign substance ejecting drain pipe 18 are provided inside the circulation pipe 10, it does not matter which one of the partition plates 15 and 16 is provided on the upstream side in a flow direction of the plating solution 17.

Therefore, the second partition plate 16 may be provided on the upstream side. In this arrangement, the liquid in a vicinity of a liquid surface in the circulation pipe 10 is blocked off by the second partition plate 16. This causes a downward flow. Thereafter, the liquid is directed upwards by the first partition plate 15, and further flows downstream.

This makes it possible (a) for the second partition plate 16 to lead to a vicinity of a bottom of the circulation pipe 10 the heavy foreign substances that happen to be in the flow in the vicinity of the liquid surface, (b) for the first partition plate 15 to trap the heavy foreign substances. As a result, it is possible to remove the heavy foreign substances more effectively.

Alternatively, the second partition plate 16 may be provided on a downstream side of the first partition plate 15. In this arrangement, the liquid in a vicinity of a bottom of the circulation pipe 10 is blocked off by the first partition plate 15, so as to flow upwards. Thereafter, the liquid is directed downwards by the second partition plate 16, and further flows downstream.

This makes it possible (a) for the first partition plate 15 to lead to the vicinity of the liquid surface the light foreign substances that happen to be in the flow in the vicinity of the bottom, and (b) for the second partition plate 16 to trap the light foreign substances. As a result, it is possible to remove the light foreign substances more effectively.

In the present embodiment, the foreign substances are collected from the foreign substance discharging drain pipe 18 while the plating processing is carried out. Alternatively, the heavy foreign substances may be collected periodically in accordance with operation hours of the present apparatus or other physical value. Alternatively, if there is a certain spare space in the region A (a region on an upstream side of the first partition plate 15), that is, if the region A is large to a certain extent, the foreign substance ejecting drain pipe 18 may not be provided.

In the present embodiment, the openings 12*a* for squirting the plating solution 17 into the region A are provided in the side surface of the supply nozzle 12, and the bottom (lower hole) of the supply nozzle 12 is sealed. Moreover, the openings 12*a* are provided at positions lower than the upper end of the first partition plate 15.

However, the present invention is not limited to this arrangement. The openings 12*a* of the supply nozzle 12 may be provided at positions higher than the upper end of the first partition plate 15, as long as the openings 12*a* are lower than the liquid surface of the plating solution 17. Even with this arrangement, the dropping of the plating solution 17 onto the liquid surface can be prevented. Therefore, it is possible to prevent the occurrence of air bubbles and the soaring of the foreign substances.

In the present processing equipment, the supply nozzle 12 may have any shape, as long as the supply nozzle 12 does not cause the soaring of the heavy foreign substances at the bottom of the region A. Therefore, the supply nozzle 12 may have only a single opening, as long as the soaring can be prevented. The opening may be provided at the bottom of the supply nozzle 12 so as to point downwards. Alternatively, the supply nozzle 12 may be provided in the region A so as to run through the side surface 11*a* of the plating tank 11 from the bottom.

In order to prevent the soaring of the heavy foreign substances, it is preferable to adjust foreign substance (a) the squirt speed and the squirt amount of the plating solution 17 of the supply nozzle 12, and (b) to appropriately adjust the positions, the number, the squirt directions, and the squirt distances (the distances from the openings to the bottom of the region A) of the supply nozzle 12, respectively.

As described above, the preferred positions of the openings of the supply nozzle 12 are higher than the bottom surface of the region A and are lower than the upper end of the first partition plate 15 (or the liquid surface of the plating solution 17).

In the present processing apparatus, meshes of the filter 19 may be preferably coarse. With this arrangement, the foreign substances (light foreign substances and relatively small heavy foreign substances) generated in the region C pass through the filter 19, and accumulate in the regions A and B of the plating tank 11. Therefore, it is possible to reduce the number of the filters 19 necessary, and to delay the time interval between the replacements of the filter 19.

In this arrangement, the meshes of the filter 19 may be of such a size that only those foreign substances that cannot pass through the openings 12*a* of the supply nozzle 12 are removed.

Moreover, the present processing apparatus may not have the filter 19. Even with this arrangement, the foreign substances can be removed in the areas A and B of the plating tank 11. Therefore, it is possible to perform the liquid flow process (plating process) with a high quality.

In the present processing apparatus, the lower end and the side surfaces of the first partition plate 15, and the side surfaces of the second partition plate 16 are in close contact with the bottom and side surfaces of the plating tank 11, respectively. This is to prevent the plating solution 17 from leaking through (a) a gap between the lower end of the first partition plates 15 and the bottom of the plating tank 11, and (b) gaps between the side surfaces of the partition plates 15 and 16 and the side surfaces of the plating tank 11. Therefore, it is preferable to appropriately set sizes of the partition plates 15 and 16 and the plating tank 11 so as to prevent the plating solution 17 from leaking through the gaps.

In the present embodiment, the lower end of the first partition plate 15 is in close contact with the bottom of the plating tank 11 (or the circulation pipe 10), and the upper end of the first partition plate 15 is at a position lower than the liquid surface.

However, a shape of the first partition plate 15 is not limited to this. That is, a part of the first partition plate 15 may be above the liquid surface (may project out of the liquid surface), provided that the first partition plate 15 intercepts (blocks off) a portion (or a portion other than a vicinity of the liquid surface) in the vicinity of the bottom of the plating tank 11 (or circulation pipe 10) so that the liquid (plating solution 17) can flow downstream only through a portion other than the vicinity of the bottom (or a portion in the vicinity of the liquid surface). For example, there may be provided, in a vicinity of an upper portion of the first partition plate 15 (in the vicinity of the liquid surface), a through hole or an opening through which the plating solution 17 flows.

Therefore, in one aspect of the present invention, in the foreign substance removing mechanism for removing foreign substances from a liquid used in a liquid flow process, which involves inflow and outflow of the liquid, the foreign substance removing mechanism further includes: a first partition plate that blocks off a portion of a flow path of the liquid other than a vicinity of a liquid surface (or a portion of the flow path of the liquid in a vicinity of a bottom).

Likewise, in the present embodiment, the second partition plate 16 is provided so that the upper end thereof is at a position higher than the liquid surface, and the lower end thereof is lower than the liquid surface and is not in close contact with the bottom of the plating tank 11 (or the circulation pipe 10).

However, the second partition plate 16 is not limited to this arrangement, and may be such that a part thereof is in contact with the bottom of the plating tank 11 (or the circulation pipe 10), provided that the second partition plate 16 blocks off a portion (or a portion other than a vicinity of the liquid surface) in the vicinity of the liquid surface of the plating tank 11 (or circulation pipe 10) so that the liquid (plating solution 17) can flow downstream only through a portion other than the vicinity of the liquid surface (or a portion in the vicinity of the bottom). For example, there may be provided, in the vicinity of the bottom of the second partition plate 16, a through hole or an opening through which the plating solution 17 flows.

Therefore, in one aspect of the present invention, in the foreign substance removing mechanism for removing foreign substances from a liquid used in a liquid flow process, which involves inflow and outflow of the liquid, the foreign substance removing mechanism further includes: a first partition plate that blocks off a portion of a flow path of the liquid other than a vicinity of a liquid surface (or a portion of the flow path of the liquid in a vicinity of a bottom); and a second partition plate that blocks off a portion of the flow path of the liquid in the vicinity of the liquid surface (or a portion of the flow path of the liquid other than the vicinity of the bottom). In this case, it is preferable that the first partition plate and the second partition plate are away from each other to a certain extent (are not close to each other) so as not to hamper the liquid flow.

The present embodiment describes an example in which the bump electrode is formed on the semiconductor substrate 31 by the electrolytic plating process using the present processing apparatus. However, the present processing apparatus can be used for a process other than the formation of the bump electrode. Moreover, it is possible to perform electroless plating.

The present embodiment describes an example in which the foreign substance removing mechanism of the present invention is applied to the plating processing apparatus used for manufacturing semiconductor devices (semiconductor integrated circuits).

However, application of the foreign substance removing mechanism of the present invention is not limited to processing apparatuses such as plating processing apparatuses in which liquid is circulated.

That is, the foreign substance removing mechanism of the present invention may be used for any kind of apparatuses, such as processing apparatuses that do not involve the circulation of liquid (processing apparatuses that do not use the liquid that is once used for the process), provided that the apparatuses are liquid flow processing apparatuses which perform a process that involves inflow and outflow of a liquid (liquid flow process).

Therefore, the foreign substance removing mechanism of the present invention may be applied to any type of apparatuses, such as processing apparatuses used in a process other than a plating process in manufacturing semiconductor devices (semiconductor integrated circuits), and apparatuses used in manufacturing products other than semiconductor devices.

One example of the liquid flow processing apparatuses is a cleaning apparatus that uses a chemical solution and that is used in manufacturing electronic devices such as semiconductor devices.

In the present embodiment, the liquid flow processing apparatus of the present invention is described as the plating processing apparatus. However, the liquid flow processing apparatus of the present invention is not limited to the plating processing apparatus, and may be applied to any kind of apparatuses, such as the cleaning apparatus described above, as long as the apparatuses perform the process that involves inflow and outflow of a liquid (liquid flow process).

In one aspect of the present invention, in the foreign substance removing mechanism provided in a liquid flow processing apparatus, for a liquid flow process, which involves inflow and outflow of the liquid, the foreign substance removing mechanism includes: a first partition plate, provided in a flow path of the liquid, whose lower end is in close contact with a bottom of the flow path, and whose upper end is at a position lower than a liquid surface.

Further, in one aspect of the present invention, the foreign substance removing mechanism provided in a liquid flow processing apparatus including a liquid flow processing tank for performing a process that involves inflow and outflow of the liquid, the foreign substance removing mechanism includes: a first partition plate, provided in a flow path of the liquid, whose lower end is in close contact with a bottom of the flow path, and whose upper end is at a position lower than a liquid surface.

In the present embodiment, the partition plates 15 and 16 are made of the same material as that constituting the plating tank 11. However, the partition plates 15 and 16 are not limited to this, and may be made of a material different from the material of the plating tank 11.

As described above, in a foreign substance removing mechanism (the present removing mechanism) of the present invention for removing foreign substances from a liquid used in a liquid flow process, which involves inflow and outflow of the liquid, the foreign substance removing mechanism includes a first partition plate, whose lower end is in close contact with a bottom of a flow path of the liquid, and whose upper end is at a position lower than a liquid surface.

The present removing mechanism removes foreign substances from a liquid (chemical solution, water, or the like) used for a process such as a plating process and a cleaning process that involves inflow and outflow of the liquid.

The present removing mechanism is provided on a downstream side or a upstream side, in the flow path (e.g. pipe for liquid flow) of the liquid, of the apparatus (liquid flow apparatus) that performs the liquid flow process so as to have a function of removing the foreign substances from the liquid that flows in the flow path.

Here, the foreign substances indicate substances that hinder the liquid flow process. Examples of the foreign substances are such litter, dust, and air bubbles that are floating or deposited in the liquid.

Roughly speaking, the foreign substances are classified into light foreign substances and heavy foreign substances. The light foreign substances are smaller in specific gravity than the liquid. Usually, the light foreign substances are floating in a vicinity of the liquid surface. On the other hand, the heavy foreign substances are larger in specific gravity than the liquid. In many cases, the heavy foreign substances flow at the bottom of the flow path or are deposited at the bottom of the flow path.

The present removing mechanism includes the first partition plate, whose lower end is in close contact with the bottom of the flow path of the liquid, and whose upper end is lower than the liquid surface. The first partition plate blocks off those portions of the flow path that are not in the vicinity of the liquid surface.

In this way, in the present removing mechanism, the liquid passes above the first partition plate at a position where the first partition plate is provided.

Therefore, in the present removing mechanism, the liquid that flows in the vicinity of the bottom of the flow path moves upwards along the first partition plate. The heavy foreign substances moving in the vicinity of the bottom do not tend to follow such an upward movement, and therefore sink and accumulate in a vicinity of the lower end of the first partition plate, so as not to flow into a downstream side of the plate.

Thus, the present removing mechanism is capable of blocking off a flow of the heavy foreign substances by the first partition plate.

This allows the present removing mechanism to remove the heavy foreign substances from the liquid without providing, in the flow path, a filter for the heavy foreign substances. As a result, it is possible to reduce the burden of maintenance of the filter, thereby reducing costs for the removal of the foreign substances (costs for the liquid flow process).

It is preferable that both side surfaces of the first partition plate are in close contact with surfaces of sidewalls of the flow path.

Moreover, it is preferable that the present removing mechanism includes a second partition plate, in the flow path of the liquid, whose upper end is at a position higher than the liquid surface, and whose lower end is lower than the liquid surface and is not in close contact with the bottom of the flow path.

In this arrangement, the second partition plate blocks off a portion other than the vicinity of the bottom in the flow path.

Therefore, in the present removing mechanism, the liquid flows below the lower end of the second partition plate at the position where the second partition plate is installed.

Therefore, in this arrangement, the liquid flowing in the vicinity of the liquid surface in the flow path moves downwards along the second partition plate. At this time, the light foreign substances floating in the vicinity of the liquid surface do not tend to follow such a downward movement, and therefore float and accumulate on the liquid surface in the vicinity of the second partition plate, so as not to flow into a downstream side of the plate.

Thus, with this arrangement, the flow of the light foreign substances can be blocked off by the second partition plate.

This makes it possible to remove the light foreign substances from the liquid without providing, in the flow path, a filter for the light foreign substances. As a result, it is possible to further reduce the burden of maintenance of the filter, thereby further reducing the costs for the removal of the foreign substances (costs for the liquid flow process).

It is preferable that both side surfaces of the second partition plate 2 are, at least below the liquid surface, in close contact with the surfaces of the sidewalls of the flow path.

In case the present removing mechanism includes the second partition plate, it is preferable that the second partition plate 2 is provided so that the lower end thereof is lower than the upper end of the first partition plate. This ensures that the flow path is blocked off at every height by at least one of the partition plates. Therefore, it is possible to prevent those foreign substances that are flowing in a vicinity of a middle of the liquid flow from slipping (scrape) through the partition plates.

In this case, the second partition plate may be provided on an upstream side of the first partition plate in the flow path. In this arrangement, the liquid in the vicinity of the liquid surface is blocked off by the second partition plate, so as to form a downward flow. Thereafter, the liquid is directed upwards by the first partition plate, so as to further flow downstream.

This makes it possible for the second partition plate to lead, to the vicinity of the bottom, the heavy foreign substances that happen to be in the flow in the vicinity of the liquid surface, so that the first partition plate traps the heavy foreign substances. As a result, it is possible to remove the heavy foreign substances more effectively.

Alternatively, the second partition plate-may be provided on a downstream side of the first partition plate in the flow path. In this arrangement, the liquid in the vicinity of the bottom of the flow path is blocked off by the first partition plate, so as to form an upward flow. Thereafter, the liquid is directed downwards by the first partition plate, so as to further flow downstream.

This makes it possible for the first partition plate to lead, to the vicinity of the liquid surface, the light foreign substances that happen to be in the flow in the vicinity of the bottom, so that the second partition plate traps the light foreign substances. As a result, it is possible to remove the light foreign substances more effectively.

In case where the second partition plate is provided on a downstream side of the first partition plate in the flow path, it is preferable that the upper end of the first partition plate is inclined toward an upstream side. In this arrangement, by inclining the upper end toward the upstream side, an angle between the first partition plate and a normal line direction of the liquid surface becomes narrower than 90°. Therefore, it is possible to smoothen the flow of the liquid that has moved beyond the first partition plate.

If the angle of the first partition plate is 90°, the liquid that has flown beyond (overflown) the first partition plate falls perpendicularly onto the bottom surface of the flow path in a region between the second partition plate and the first partition plate.

On the other hand, if the angle of the first partition plate is set to 90° or less by inclining the upper end of the first partition plate toward the upstream side, it is possible to smoothen the flow of liquid toward the bottom of the region. Therefore, it is possible to buffer a shock caused when the liquid hits the bottom, thereby preventing the occurrence of air bubbles.

In this arrangement, it is preferable that the second partition plate is parallel to the first partition plate. This makes it possible to keep constant a liquid flow area in the region between the first partition plate and the second partition plate (area that varies depending on a distance between the partition plates).

This prevents variations of flow speed and flow pressure of the liquid. As a result, it is possible to prevent the light foreign substances (that are about to float) from being involved into the flow of the liquid, and to prevent the occurrence of air bubbles, and the like.

Moreover, a foreign substance removing tank that removes the foreign substances may be provided in the flow path of the liquid. The foreign substance removing tank includes the first partition plate, the second partition plate, an inflow nozzle for letting the liquid into the foreign substance removing tank, and an outlet for discharging the liquid.

In this arrangement, the liquid is squirted from the inflow nozzle into a region (first region) between a side surface (side surface on an upstream side in a flow direction of the liquid) of the foreign substance removing tank and the first partition plate.

In this arrangement, it is preferable that the inflow nozzle squirts the liquid into such a position that is lower than the liquid surface in the first region. This prevents dropping of the liquid from above the liquid surface in the first region. Therefore, it is possible to prevent the occurrence of air bubbles.

It is more preferable that the inflow nozzle squirts the liquid into a position lower than the upper end of the first partition plate.

This arrangement ensures that the liquid supplied to the first region is directed upwards and moves toward a region (second region) between the second partition plate and the first partition plate. Therefore, this arrangement makes it easy to cause, to sink to the bottom surface of the first region, the heavy foreign substances that have flown into the first region.

It is preferable that the inflow nozzle squirts the liquid in such a manner as to avoid the soaring of the foreign substances deposited at the bottom of the first region (heavy foreign substances).

That is, it is preferable that the flow speed, flow pressure, flow amount, and flow direction (direction of the flow) of the liquid squirted by the inflow nozzle are configured so that a power with which the liquid is squirted has no significant influence on the bottom.

Such a configuration can be made by designing the inflow nozzle so as to have a cylindrical shape and a plurality of openings, on a side surface thereof, for squirting the liquid. Because the liquid is squirted from the plurality of openings with this arrangement, it is possible to suppress the flow pressure of the liquid, thereby reducing the influence (pressure) upon the foreign substances.

Moreover, the foreign substance removing tank may be integrally provided with the liquid flow processing tank that performs the process involving the inflow and outflow of the liquid. With this arrangement, the liquid that has flown beyond the second partition plate directly flows into the liquid flow processing tank. This simplifies the arrangement of the liquid flow processing apparatus.

The foreign substance removing tank may be a part of the liquid flow processing tank. With this arrangement, the first and second partition plates and the inflow nozzle are provided in a part (upstream-side portion) of the liquid flow processing tank. The inflow nozzle and the outlet function to supply and discharge the liquid to and from the liquid flow processing tank.

Moreover, in the present removing mechanism, the number of the first partition plates may be plural (a plurality of first partition plates may be provided side by side, for example). This makes it possible to remove the heavy foreign substances more effectively.

Moreover, in the present removing mechanism, the number of the first partition plates and/or the second partition plates may be plural. If the number of the first partition plates is increased, the heavy foreign substances can be removed more effectively. If the number of the second partition plates is increased, the light foreign substances can be removed more effectively.

Moreover, it is preferable that the present removing mechanism includes a foreign substance removing drain pipe provided at a bottom part on an upstream side of the first partition plate in the flow path. Therefore, by providing the foreign substance removing drain pipe at this part, the heavy foreign substances can be collected easily.

Moreover, the present removing mechanism may include a filter, in the flow path of the liquid, for removing the foreign substances.

By thus using the first and second partition plates and the filters in the present removing mechanism, it is possible to remove the foreign substances more effectively.

As described above, the present removing mechanism is capable of removing most of the foreign substances by the first and second partition plates. Therefore, even if the filters are thus used, the number of the filters may be reduced. Moreover, the time interval (life of the filter) between the replacements of the filters can be fully prolonged. As a result, costs and labor for the maintenance of the filters are very small.

In cases where (a) the filter is provided on an upstream side of the first and the second partition plates in the flow path, or (b) the liquid is circulated, it is preferable that the filter is very coarse-grained so that the filter traps only a small number of the foreign substances. On the other hand, in a case where the filter is provided on a downstream side of the first and second partition plates in the flow path, any filter may be used. However, it is preferable to use a filter that is capable of removing the foreign substances (medium foreign substances) whose specific gravity is equivalent to that of the liquid.

Moreover, by combining the present removing mechanism and the liquid flow processing tank that performs the process involving the inflow and outflow of the liquid, it is possible to easily constitute a liquid flow processing apparatus capable of excellently performing liquid flow process by using the liquid from which the foreign substances have been removed.

For example, (a) a plating solution for gold plating may be used as the liquid, and, (b) a plating tank, that forms a bump electrode made of gold plate at a predetermined position of a semiconductor substrate on which a semiconductor device is mounted, may be used as the liquid flow processing tank. With this arrangement, it is possible to realize a plating processing apparatus capable of carrying out a high-quality gold plating process.

Moreover, a foreign substance removing method of the present invention for removing foreign substances from a liquid used in a liquid flow process, which involves inflow and outflow of the liquid, includes the step of removing the foreign substances by using a first partition plate whose lower end is in close contact with a bottom of a flow path of the liquid and whose upper end is at a position lower than a liquid surface.

The foreign substance removing method is employed in the present removing mechanism. In this method, it is possible to block off the flow of the heavy foreign substances by using the first partition plate.

This makes it possible to remove the heavy foreign substances from the liquid without providing, in the flow path, a filter for the heavy foreign substances. As a result, it is possible to reduce the burden of maintenance of the filter, thereby reducing costs for the removal of the foreign substances (i.e., costs for the liquid flow process).

In another aspect, the present invention relates to an apparatus for manufacturing a semiconductor integrated circuit and the like, and a method of manufacturing a semiconductor integrated circuit and the like by using the apparatus. Moreover, in one aspect, FIG. 6 is a schematic cross-sectional view of the plating tank which is used for carrying out a conventional foreign substance removing method.

In the conventional apparatus (see FIG. 6), a part of the heavy foreign substances are soared in accordance with a flow of the chemical solution in the area C, and are attached to a substrate that is to be processed (e.g. semiconductor substrate). This causes, in carrying out the plating process for example, a plating error at a portion to which the heavy foreign substances are attached, thereby decreasing a yield of products.

According to the present invention, it is possible to reduce the time and costs for the maintenance of the plating apparatus, because light foreign substances and heavy foreign substances can be efficiently removed without using the filter which has been conventionally required.

Moreover, it may be arranged so that the plating solution 17 circulate in the plating tank in the following manner: the plating solution 17 (1) is pressurized by the circulation pump 14; (2) flows from the plating solution supply nozzle 12 into the plating tank 11 via the filter 19; (3) flows through the regions A, B, and C in this order; (4) is discharged from the discharge nozzle 13; and (5) is again pressurized by the circulation pump 14.

Usually, the partition plates of the plating tank 11 are provided, for example, perpendicular to the liquid surface of the plating solution 17, in other words, in the normal line direction of the liquid surface. However, by providing the partition plates at predetermined angles with respect to the normal line direction, the foreign substances can be removed more effectively. If the first partition plate 15 is provided at a predetermined angle, the plating solution 17 that has been initially filled has overflown the first partition plate 15 and is directed to the region B, and then flows into the region C more smoothly than the case where the plating solution 17 that has overflown perpendicularly falls onto the bottom surface of the region B. Therefore, it is possible to buffer a shock caused when the plating solution 17 hits the bottom surface of the region B, thereby suppressing the occurrence of air bubbles.

This becomes more effective if the angles of the partition plates 15 and 16 are as horizontal as possible with respect to the liquid surface, that is, with respect to the bottom surface. However, in light of a permissible space in the plating tank 11 and a reduction of an amount of the plating solution 17 to be used, the angle between the liquid surface and the partition plates 15 and 16 may be 75° so that, as shown in FIG. 1, the region A becomes narrower toward an upper portion thereof and wider towards a lower portion thereof, that is, toward the bottom surface of the plating tank 11.

In the arrangements shown in FIGS. 1, 4, and 5, the regions for removing the foreign substances and the plating tank 11 are integrally provided. However, the gist of the present invention can be fulfilled even if the regions for removing the foreign substances and the plating tank are separately provided.

Moreover, in the case of controlling the liquid surface of the plating tank 11, it may be so arranged that, when the liquid surface reaches a certain water level (e.g. 160 mm), the control section performs a calculation and adjusts the supply amount of the circulation pump 14 so that the supply amount and the discharge amount are fixed.

The present invention may also be defined as the following first through seventh processing apparatuses. Namely, the first processing apparatus, in which a chemical solution is supplied through an inlet into a processing tank and the chemical solution that has been used for a process is discharged from an outlet, is arranged so that the processing tank is partitioned by a first partition plate and a second partition plate that are provided in this order from the inlet side.

Moreover, in addition to the structure of the first processing apparatus, the second processing apparatus is arranged as follows: the first partition plate is provided such that (i) an upper end thereof is lower than a liquid surface of the chemical solution in the processing tank, (ii) both side surfaces thereof are in close contact with side surfaces of the processing tank, and (iii) a lower end thereof is in close contact with a bottom surface of the processing apparatus; and the second partition plate is provided such that (a) an upper end thereof is higher than the liquid surface of the chemical solution in the processing tank, (b) both side surfaces thereof are in close contact with the side surfaces of the processing tank, and (c) a lower end thereof has a predetermined gap with respect to the bottom surface of the processing apparatus, and is lower than the upper end of the first partition plate.

Moreover, in addition to the structure of the first processing apparatus or the second processing apparatus, the third processing apparatus is arranged such that the first partition plate has a predetermined angle with respect to a normal line direction of the liquid surface of the chemical solution. Moreover, in addition to the structure of any one of the first through third processing apparatuses, the fourth processing apparatus is arranged such that the second partition plate is substantially parallel to the first partition plate.

Moreover, in addition to the structure of any one of the first through fourth processing apparatuses, the fifth processing apparatus is arranged such that the inlet, through which the chemical solution is filled into the processing tank, is provided at a position lower than the liquid surface of the chemical solution in the processing tank and higher than the bottom surface of the processing tank. Moreover, in addition to the structure of the fifth processing apparatus, the sixth processing apparatus is arranged such that the inlet, through which the chemical solution is filled into the processing tank, has a plurality of openings from which the chemical solution is not directly squirted against the bottom surface of the processing tank. Moreover, the seventh processing apparatus is arranged so as to carry out gold (Au) plating, by using a plating solution as the chemical solution, for forming a bump electrode at a predetermined position of a semiconductor substrate on which a semiconductor integrated circuit is mounted.

Moreover, in the present invention, the processing tank such as the plating tank of the plating apparatus may be partitioned by the first partition plate and the second partition plate in this order from the side of the inlet, through which the chemical solution is filled into the processing tank so that the tank is partitioned into three regions.

It is preferable that the first partition plate is such that the upper end thereof is lower than the liquid surface of the chemical solution in the processing tank, the both side surfaces thereof are in close contact with the side surfaces of the processing tank, and the lower end thereof is in close contact with the bottom surface of the processing tank. It is preferable that the second partition plate is such that the upper end thereof is higher than the liquid surface of the chemical solution in the processing tank, the both side surfaces thereof are in close contact with the processing tank, and the lower end thereof has a predetermined gap with respect to the bottom surface of the processing apparatus. Moreover, it is preferable that the second partition plate is provided such that the lower end thereof is lower than the upper end of the first partition plate.

Furthermore, it is preferable that the first partition plate and the second partition plate have a predetermined distance therebetween. Moreover, the first partition plate and the second partition plate may be perpendicular to the liquid surface of a processing solution filled in the processing tank, or may be inclined at predetermined angles with respect to a direction perpendicular to the liquid surface.

The chemical solution is filled, through the inlet into the processing tank, into a region (first foreign substance trap) comparted by the processing tank and the first partition plate. Among the foreign substances floating in the chemical solution, the heavy foreign substances precipitate onto a bottom surface of the first foreign substance trap. It is therefore preferable to provide, on the bottom surface of the first foreign substance trap, an outlet for discharging the foreign substances that have precipitated so as to discharge the foreign substances periodically out of the processing tank.

The chemical solution then overflows the upper end of the first partition plate, and flows into a region (second foreign substance trap) formed by the first partition plate and the second partition plate. If (a) the second partition plate is arranged such that the lower end thereof has a gap with respect to the bottom surface of the processing tank, and (b) the upper end thereof is higher than the liquid surface of the chemical solution, the chemical solution will never overflow the upper end of the second partition plate into a next region of the processing tank. That is, the light foreign substances in the chemical solution float on the liquid surface of this region, so as not to flow into the next region.

Moreover, in the processing tank of the present invention, the number of the filters for removing the foreign substances is fewer than that of a conventional processing tank. Therefore, it is possible to drastically reduce in removing the foreign substances the costs and time for the maintenance of the processing tank. That is, according to the present invention, it is possible to drastically reduce the number of the filters necessary for removing the foreign substances in the chemical solution, thereby drastically reducing the costs for the purchase of the filters, and the time required for replacing the filters.

The specific embodiment and example described in BEST MODE FOR CARRYING OUT THE INVENTION are only to clarify technical contents of the present invention. The present invention is therefore not to be interpreted in a narrow sense as being limited by such specific examples. In other words, the present invention may be varied in many ways within the scope of the spirit of the present invention and within the scope of the following claims.

INDUSTRIAL APPLICABILITY

The present invention relates to a foreign substance removing mechanism and a foreign substance removing method for removing foreign substances from a liquid used for a liquid flow process, which involves inflow and outflow of the liquid. The present invention can be used, for example, in a liquid flow processing apparatuses (such as plating processing apparatuses) including the foreign substance removing mechanism.

The invention claimed is:

1. A foreign substance removing mechanism for removing foreign substances from a liquid used in a liquid flow process, which involves inflow and outflow of the liquid, the foreign substance removing mechanism comprising:

a first partition plate, whose lower end is in contact with a lower surface of a flow path of the liquid, and whose upper end is at a position lower than a liquid surface, a second partition plate, provided on a downstream side of the first partition plate, whose upper end is higher than the liquid surface, and whose lower end is lower than the liquid surface and is provided so as not to be in contact with the bottom of the flow path, said first and second partition plates being provided in the flow path of the liquid, wherein the upper end of the first partition plate is provided so as to be inclined toward an upstream side, and the lower end of the second partition plate is at a position lower than the upper end of the first partition plate, and the second partition plate is parallel to the first partition plate, an inflow nozzle positioned upstream of said first partition plate, an outlet positioned downstream of said second partition plate, wherein the inflow nozzle being provided so as to squirt the liquid into such a position in a first region that is lower than the liquid surface and at a position lower than the upper end of the first partition plate, the first region being between a side surface and the first partition plate, the inflow nozzle squirting the liquid so as to avoid disbursement of the foreign substances deposited at the bottom of the first region, the inflow nozzle having a cylindrical shape; and the inflow nozzle having, at a side surface thereof, a plurality of openings for squirting the liquid.

2. The foreign substance removing mechanism as set forth in claim 1, wherein:

an angle between the liquid surface and a plane including the first partition plate is a minimum of approximately 75°.

3. The foreign substance removing mechanism as set forth in claim 1, wherein:

the flow path defines a foreign substance removing tank and said tank is in liquid communication with a liquid flow processing tank for performing the process that involves the inflow and outflow of the liquid.

4. The foreign substance removing mechanism as set forth in claim 1, wherein:

said foreign substance removing mechanism further comprises additional plates substantially identical to the first partition plate which are upstream of said first partition plate.

5. The foreign substance removing mechanism as set forth in claim 1, wherein:

said foreign substance removing mechanism further comprises a plurality of alternating first and second partition plates.

6. A foreign substance removing mechanism as set forth in claim 1, further comprising:

a foreign substance removing drain pipe provided at the bottom of the flow path, upstream of the first partition plate in the flow path.

7. A foreign substance removing mechanism as set forth in claim 1, further comprising:

a filter, provided downstream of said outflow and in liquid communication with said inflow, for removing foreign substances upstream of said inflow.

8. The foreign substance removing mechanism as set forth in claim 1, wherein:

a width of a gap between the upper end of the first partition plate and the liquid surface is identical with a width of a gap between the lower end of the second partition plate and the bottom end of the flow path.

9. A liquid flow processing apparatus, comprising:

the foreign substance removing mechanism as set forth in claim 1; and a liquid flow processing tank for performing the process that involves the inflow and outflow of the liquid.

10. The liquid flow processing apparatus as set forth in claim 9, wherein:

the liquid is a plating solution for gold plating; and the liquid flow processing tank is a plating tank for forming a bump electrode made of gold plate at a predetermined position of a semiconductor substrate on which a semiconductor device is mounted.

11. A foreign substance removing method for removing foreign substances from a liquid used for a liquid flow process, which involves inflow and outflow of the liquid, the foreign substance removing mechanism comprising the step of:

removing the foreign substances by using a foreign substance removing mechanism for removing foreign substances from a liquid used in a liquid flow process, which involves inflow and outflow of the liquid, the foreign substance removing mechanism comprising:

a first partition plate, whose lower end is in contact with a lower surface of a flow path of the liquid, and whose upper end is at a position lower than a liquid surface, a second partition plate, provided on a downstream side of the first partition plate, whose upper end is higher than the liquid surface, and whose lower end is lower than the liquid surface and is provided so as not to be in contact with the bottom of the flow path, said first and second partition plates being provided in the flow path of the liquid, wherein the upper end of the first partition plate is provided so as to be inclined toward an upstream side, and the lower end of the second partition plate is at a position lower than the upper end of the first partition plate, and the second partition plate is parallel to the first partition plate, an inflow nozzle positioned upstream of said first partition plate, an outlet positioned downstream of said second partition plate, wherein the inflow nozzle being provided so as to squirt the liquid into such a position in a first region that is lower than the liquid surface and at a position lower than the upper end of the first partition plate, the first region being between a side surface and the first partition plate, the inflow nozzle squirting the liquid so as to avoid disbursement of the foreign substances deposited at the bottom of the first region, the inflow nozzle having a cylindrical shape; and the inflow nozzle having, at a side surface thereof, a plurality of openings for squirting the liquid.

* * * * *